US005919558A

United States Patent [19]

Chao

[11] Patent Number: 5,919,558

[45] Date of Patent: Jul. 6, 1999

[54] INKJET RECORDING SHEET

[75] Inventor: Hung-Tai Chao, Cumberland, Md.

[73] Assignee: Westvaco Corporation, New York, N.Y.

[21] Appl. No.: 08/833,544

[22] Filed: Apr. 7, 1997

Related U.S. Application Data

[60] Provisional application No. 60/019,360, Jun. 5, 1996.

[51] Int. Cl.[6] ..... B41M 5/00

[52] U.S. Cl. ..... 428/327; 428/195; 428/211; 428/330; 428/342; 428/409; 428/500; 428/511; 428/537.5

[58] Field of Search ..... 428/195, 500, 428/330, 211, 537.5, 327, 342, 409, 511

[56] References Cited

U.S. PATENT DOCUMENTS

| | | | |
|---|---|---|---|
| 4,425,405 | 1/1984 | Murakami et al. | 428/342 |
| 4,503,111 | 3/1985 | Jaeger et al. | 428/195 |
| 4,636,409 | 1/1987 | Arai et al. | 428/211 |
| 5,320,897 | 6/1994 | Kondo et al. | 428/195 |
| 5,478,631 | 12/1995 | Kawano et al. | 428/195 |
| 5,851,651 | 12/1998 | Chao | 428/211 |

*Primary Examiner*—Pamela R. Schwartz

[57] ABSTRACT

The inkjet recording sheet of the present invention comprises a cellulosic sheet support, e.g., paper, bearing on at least one surface thereof an inkjet coating comprising one or more water soluble binders for fixing the images printed with inkjet inks and one or more pigment components having high absorption capacity for absorbing the vehicle of the inkjet inks at a pigment to binder ratio of about 10 to 1.

2 Claims, No Drawings

INKJET RECORDING SHEET

This is a provisional Application of Ser. No. 68/019,360, filed Jun. 5, 1996.

BACKGROUND OF INVENTION

The present invention relates to an inkjet recording sheet, and more particularly to an inkjet recording sheet prepared from a cellulosic support such as paper, on which there is applied an inkjet coating providing superior performance.

The most successful inkjet recording sheets presently in use employ non-cellulosic polymer supports because of their exceptional smoothness. However, as the use of inkjet printers becomes more widespread, there is a growing need for developing inkjet sheets using cheaper and more economical substrates such as paper. The use of paper as a substrate for an inkjet recording sheet provides some advantages, such as low cost and the ability to absorb the ink vehicle rapidly during printing, but the main disadvantage is a lack of smoothness as compared with non-cellulosic, polymer substrates.

Inkjet systems are comprised of three components, the printer, the ink and the recording sheet. The printer controls the size, number and placement of the ink droplets and contains the transport system. The ink provides the colorants which form the image, and the recording sheet provides the medium or substrate which accepts and holds the ink. The quality and archivability of ink jet prints is a function of the total system. However, the composition and interaction of the ink and the recording sheet most affect the quality and archivability of the imaged product.

There are two primary requirements for inkjet printing. The first is that the coating, and the substrate in the case of paper supports, must be absorbent enough to immobilize the vehicle of the inks so that the inks will not smear permitting fast ink drying and high printing speeds. The second requirement is that the coating provide a means for keeping the dyes in the inks on the surface of the sheet with minimal spreading, tailing or blurring of dots to provide a sharp image. If the dyes are not kept on the surface of the sheet the colors could fade since the dyes will become diluted by the high light scattering ability of the preferred pigments used in inkjet coatings.

Fast drying properties have been achieved in the past by incorporating silica or other pigments of large specific surface area in the inkjet recording layer so as to increase ink absorption. However, an inkjet recording layer with a pigment of large specific surface area provides a surface having low smoothness. As a result, the appearance of the image deteriorates and the reproduction of the image becomes unsatisfactory. Enhanced smoothness can be achieved, however, by calendering or supercalendering the inkjet recording sheet, but this action tends to destroy the porosity of the inkjet recording layer resulting in a decrease in the ink absorption and reduced drying properties. Nevertheless, emphasis in the prior art has dictated the use of nonflake-like pigments for use in inkjet coatings. Nonflake-like pigments include calcium carbonate, silicas, calcined clays and other such pigments whereas flaky pigments include clays, talc and mica.

Typical binders for inkjet coatings disclosed in the prior art are water soluble and non-water soluble polymeric binders including polyvinyl alcohol, polyvinyl alcohol copolymers such as poly (vinyl alcohol-co-vinyl acetate), hydroxypropyl cellulose, acrylic resins such as poly (methyl methacrylate/ethyl acrylate/acrylic acid), sodium alginate, water soluble phenol formaldehyde resins, carboxylated styrene butadine polymers, carboxymethyl cellulose, hydroxyurethanes, soluble collagen gelatin, hydrolyzed ethylene vinyl acetate polymers, and polysaccharides such as xanthene gum, gum tragacanth, locust bean gum, guar gum, and agur, etc. Also noted in the prior art are aqueous dispersions of poly(vinylpyrrolidone), vinylpyrrolidone-vinyl acetate copolymers, or mixtures thereof. U.S. Pat. No. 4,425,405 discloses such a mixture applied on at least one surface of a paper substrate or incorporated internally of the substrate with a white filler in a pigment-to-binder weight ratio of 10:1 to 0.2:1. In addition, U.S. Pat. No. 4,503,111 discloses the use of poly(vinylpyrrolidone) as the binder in an inkjet recording sheet which uses a hydrophobic substrate prepared from a flexible, transparent plastic material.

However, in accordance with the present invention, a novel coating formulation has been discovered which utilizes many of the components disclosed in the prior art but which produces superior performance when applied to a paper substrate. The present invention is characterized by a careful blending of water soluble binder materials and pigment components to achieve a high level of success.

SUMMARY OF INVENTION

The present invention is directed to an improved inkjet coating sheet comprising a paper substrate having applied to at least one surface thereof an inkjet printing coating comprising water soluble binders and pigments in a high pigment-to-binder ratio of about 10 to 1. The preferred pigments used in the inkjet coating comprise calcium carbonate, in particular fine ground calcium carbonate sold under the tradename FGCC HG by Omya Company, but the pigment component may be supplemented with other pigments including titanium dioxide ($TiO_2$), and plastic pigments, e.g., ROPAQUE HP-1055, a product of Rohm and Haas or DP 755, a product of Dow Chemical Company. The preferred binder for the inkjet coating of the present invention consists essentially of water soluble polymeric material, e.g. poly(vinylpyrrolidine) PVP, or a copolymer of PVP-vinyl acetate, and POLY P1, a product of BASF.

In addition to the above defined primary ingredients of the inkjet printing coating, the coating formulation may contain other additives, e.g., surfactant, humectant, UV absorber, pigment dispersant, defoamer, mold inhibitor, antioxidant, latex, dye mordant and optical brighteners as are known to those skilled in the art. The relative proportion of filler component to binder component is about 10 to 1, but may be greater or less depending upon the type of pigment used, the type of substrate, and the ability of the binder to adequately hold the pigment to prevent dusting.

Useful substrates include both cellulose and non-cellulose type supports, although cellulose type supports such as paper are preferred. The degree of sizing for the support can be from 1 second to about 1000 seconds as measured by the Hercules size test (HST), as described in TAPPI standards T530 pm-83. The support is chosen so its HST value is compatible with the volume and composition of the ink drop in the printer to be used. The preferred HST is within the range of from about 200 to 500 seconds, and most preferably between about 300 to 400 seconds. The surfaces of the paper substrate on which the inkjet print coating is applied should be relatively smooth with a BEKK smoothness of about 500 seconds. In addition, cellulosic sheets of high brightness are preferred which have good opacity.

The inkjet printing coating is applied to one or both surfaces of the substrate by a coating means known to those skilled in the art. Suitable coating methods include conventional roll coaters or blade coating methods, e.g., air, knife, trailing blade, etc. The coating formulation may be applied directly to the substrate surface from a single solution or it may be applied over a previously applied hold-out coating where desired. The differences between the processes are many, including process speed, coating viscosity, coating solids, types of materials that can be applied, the depth of penetration of the material into the substrate, and the surface characteristics of the substrate coming out of the coating process which ultimately determines the quality of the recording sheet produced.

The inkjet printing coating is applied to the substrate at a coat weight of from about 5–10 lbs/ream (one or both sides), ream size 3,300 sq. ft, and most preferably at a coat weight of 7–9 lbs/ream. The coating formulation can be made in a variety of ways. A typical coating is made by first taking the most difficult pigment for shearing and adding it to water in which a dispersant has been mixed. The combination of dispersant, water and pigment is agitated at high speeds to develop the shear to break down the pigment into its smallest component part. The next pigment is then added with additional water and dispersant if necessary. Meanwhile, the binder is prepared, by cooking if necessary, and subsequent cooling to a temperature that will not shock the pigment. The binder or binders are then added to the coating formulation with any other desired additives that are typically used for rheology modification, flow characteristics, stability or functional properties. Following is a typical coating formulation for the present invention.

TABLE I

| InkJet Coating | |
|---|---|
| Coating Material | Dry Weight |
| Organic pigment | 1000–3000 lbs. |
| Plastic pigment | 600–1200 lbs. |
| Binder (water soluble) | 300–450 lbs. |
| Whitening Agent | 25–50 lbs. |
| Binder (water soluble) | 18–25 lbs. |
| Dispersant | 16–20 lbs. |
| Defoamer | 4 pts. |
| Dye-Blue | 10 oz. |

The coating pigments listed in Table I include a fine ground calcium carbonate material (FGCC) supplied by Omya Company, and a hollow sphere plastic polymer pigment for increased opacity, e.g., ROPAQUE HP-1055 supplied by Rohm & Haas. The binder materials used in the coating include PVP, a poly(vinylpyrrolidone) polymeric material supplied by BASF Corporation and Poly P1, also a BASF product in the form of a cationic polymer. The Poly P1 provides good rheology for the coating at high shear, particularly for blade coating. In addition to the above ingredients, a fluorescent whitening agent (FWA T-110) is added with suitable dispersants and defoamers. Ingredients of this type provide a high quality inkjet coating having a pigment to binder ratio of about 12:1 which is preferably applied to both sides of a suitable paper substrate in an amount of about 7–9 lbs/ream (each side), and most preferably at about 8 lbs/ream (ream size 3300 sq. ft). An example of a suitable substrate is an 80 lb litho gloss C1S (coated one side) basestock sold under the tradename CELESTA by Westvaco Corporation. This product has a very high smoothness of about 500 seconds BEKK or higher and a Cobb value (water absorbtivity) of between about 17–54 g/m$^2$.

Specific examples of coatings suitable for the present invention are shown in Table II.

TABLE II

| Coating Material | Wt. | 6017 | 6018 | 6019 | 6020 |
|---|---|---|---|---|---|
| $TiO_2$ | lbs. | 1000 | — | 1000 | — |
| PP 755 | lbs. | 1200 | — | — | 1200 |
| FGCC HG-90 | lbs. | 1200 | 3600 | 2600 | 2400 |
| PVP (Albigen) | lbs. | 300 | 300 | 300 | 300 |
| FWA (T-110) | lbs. | — | 50 | — | 50 |
| ALCOSPERSE | lbs. | 16 | 16 | 16 | 16 |
| Defoamer | pts. | 4 | 4 | 4 | 4 |
| Poly P1 | Ozs. | 50 | 50 | 50 | 50 |
| Dye (blue) | Ozs. | 6 | 6 | 6 | 6 |
| pH | | 8.5 | 7.8 | 8.7 | 7.6 |
| Solids | | 60.5 | 62.0 | 65.0 | 60.0 |
| Coat wt (lbs/ream) | | 5.5 | 5.5 | 5.7 | 5.9 |

After coating, samples of the coated sheets were printed using an HP Deskjet 660C color printer. In the evaluation, a number of print characteristics were examined. These included (1) ink bleed of one solid area into another solid area as well as ink bleed into unprinted areas; (2) the color intensity of the inks, particularly the reds; and, (3) the color lay of the black inks. A combination of precipitated calcium carbonate and plastic pigment was found to be superior for solid ink bleed and yellow lettering bleed into the solid black area. Ink bleeding deficiency was overcome by increasing the coat weight, e.g., going from a coat weight of about 6–8 lbs/ream to 15–19 lbs/ream. This suggested that the ink bleed problems were probably caused when the coating had insufficient pore volume to sufficiently absorb the water associated with the ink. In any event, the above description and examples are only intended to be exemplary of embodiments of the invention and variations and modifications can be made by those skilled in the art that fall within the scope of the appended claims.

What is claimed is:

1. An inkjet recording sheet comprising a paper substrate bearing on at least one surface thereof an inkjet coating, said substrate having an HST sizing within the range of from about 200 to 500 seconds, a BEKK smoothness of at least 500 seconds, and a water absorbtivity value of between 17–54 g/m$^2$ Cobb, said inkjet coating comprising a combination of pigments and binders in the ratio of about 10:1, said pigments consisting essentially of a mixture of fine around calcium carbonate and hollow sphere plastic pigment, and said binders consisting essentially of poly (vinylpyrrolidone) and a cationic polymer, said coating further comprising one or more additives selected from the group consisting of dispersants, lubricants, defoamers, insolubilizers, viscosity modifiers, polyelectrolytes, wherein the coating is applied to the substrate at a coat weight of from about 5–10 lbs/ream.

2. The inkjet recording sheet of claim 1 wherein the inkjet coating is applied to both surfaces of the substrate.

* * * * *